US005223817A

United States Patent [19]

Hoyle

[11] Patent Number: 5,223,817

[45] Date of Patent: Jun. 29, 1993

[54] ALARM SIGNAL PROCESSING MEANS

[75] Inventor: Roger W. L. Hoyle, Blackburn, Great Britain

[73] Assignee: Shorrock Limited, Blackburn, United Kingdom

[21] Appl. No.: 759,434

[22] Filed: Sep. 13, 1991

[51] Int. Cl.[5] ..... G08B 13/18

[52] U.S. Cl. ..... 340/554; 340/521; 340/562

[58] Field of Search ..... 340/552-554, 340/562-564, 521, 825.72, 661; 367/93-94; 342/27-28

[56] References Cited

U.S. PATENT DOCUMENTS

| | | | |
|---|---|---|---|
| 3,885,234 | 5/1975 | Fujimoto | 367/94 |
| 3,976,958 | 8/1976 | Seidel | 333/6 |
| 4,225,858 | 9/1980 | Cole et al. | 340/554 |
| 4,295,132 | 10/1981 | Burney et al. | 340/562 |
| 4,383,250 | 5/1983 | Galvin | 340/521 |
| 4,442,514 | 4/1984 | Roth | 367/136 |
| 4,684,932 | 8/1987 | Kupec et al. | 340/564 |

FOREIGN PATENT DOCUMENTS 2131547 6/1984 United Kingdom .

*Primary Examiner*—Thomas Mullen

*Attorney, Agent, or Firm*—Dennison, Meserole, Pollack & Scheiner

[57] ABSTRACT

An intruder detector system such as a microwave fence having a transmitter 10 and receiver 12 produces a signal proportional to the disturbance created by an intruder. The signal is processed by a microwave detector 14 and processor 16 and supplied, as DC voltage output to two channels 18, 20. First channel 18 compares the DC voltage strength to a pre-set value stored in a first threshold detector/comparator 22. On the DC voltage exceeding the pre-set value an alarm relay 24 is actuated causing actuation of an alarm (not shown). Second channel 20 passes the voltage through a first filter 26 which removes high frequency signal variations characteristic of a fast moving intruder. Thus the signal which is compared with a second pre-set value stored in a second threshold detector/comparator 28 relates only to slow moving intruders and the preset value can therefore be set for a lower level of disturbance as would be caused by a crawling human intruder.

9 Claims, 2 Drawing Sheets

ALARM SIGNAL PROCESSING MEANS

BACKGROUND OF THE INVENTION

This invention relates to alarm signal processing means particularly the processing of alarm signals generated by microwave fences and/or parallel wire intruder detection arrangements.

Two common forms of intruder detector systems used as external perimeter intrusion sensors are high frequency transmitter receiver combinations, known as microwave fences, and parallel wire capacitance change detectors known as electric field sensors. In the case of the microwave fence system a transmitter is set up facing an associated receiver and any disturbance of the received signal level as monitored by the receiver results in the generation of an alarm signal. It will be understood that a disturbance in the received signal is indicative of an intrusion into the area between the transmitter and the receiver. The size of the disturbance is proportional to the size of the intruder's radar cross-section as presented to the transmitter/receiver arrangement.

In the aforementioned parallel wire arrangement two sensor wires are supported on insulated posts parallel to each other and horizontal to the ground. They are connected to the primary wirings of a transformer and are then energised by an oscillator, the configuration being balanced by means of a potentiometer and a variable capacitor. When the circuit is balanced there is no voltage induced in the secondary winding of the transformer. However, when a person encroaches on either wire an imbalance will be induced into the system according to the proximity of the intruder to the sensor wire. This gives rise to generation of an alarm signal.

In each of these systems the alarm signal generated by the sensor devices has a value proportional to the amount of disturbance in the sensor's field. Thus, an erect walking or running person will produce a proportionately large disturbance when compared to a small animal, for example, a rabbit moving at the same speed. A problem with this type of sensor arrangement, however, is in distinguishing between a crawling human intruder and a small animal intruder, such as a rabbit, as both of these targets may cause approximately the same disturbance within the sensor field. Thus, if the sensor system is provided with a pre-set threshold value such that an alarm signal is only generated when the disturbance of the sensor field exceeds this predetermined value, the system will react to a crawling human intruder as it would to a small animal and, if the disturbance does not exceed the threshold will not generate an appropriate alarm signal.

Co-pending British Patent Application No. 2182517 proposes one way in which genuine signals indicative of an intruder penetrating a microwave fence may be distinguished from a signal generated by an animal. This is accomplished by providing two threshold detectors, one to detect a signal increase and a second to detect a signal decrease. An alarm signal will only be generated where a respective increase and decrease of the sensor field is monitored over a predetermined time period. In this way the disturbance caused by the presence of a human intruder in the detector zone which is characterised by initial small disturbances in received signal level of alternate positive and negative polarity followed by a relatively large decrease or increase in the signal level is detected. Whilst this system is successful in discriminating between disturbances produced by a human intruder and an animal it cannot distinguish when the cross-sectional area, to which the disturbance is proportional, of each intruder is approximately equal, for example, when a human intruder is crawling through the detection zone.

SUMMARY OF THE INVENTION

It is an object of the present invention therefore to provide alarm signal processing means operable to distinguish between disturbances generated by a small animal and a crawling intruder.

According to the present invention there is provided alarm signal processing means connected to an intruder detector system which outputs a signal proportional to a disturbance in the detector system's field of operation, the processing means comprising two channels connected in parallel to the detector system, a first channel including a first comparator having a first predetermined threshold value and a second channel including a filter operative to block or remove signal disturbances of above a predetermined frequency and a second comparator having a second predetermined threshold value, the first and second comparators being connected to an alarm actuator such that on detection by either comparator of a signal disturbance exceeding either of the first or second comparators respective threshold values an alarm control signal is produced to cause actuation of alarm means.

It will be understood that this processing means makes use of the fact that most commonly found animals on a protected site are of a size order approximately equivalent to a rabbit and are moving relatively quickly i.e. running, when they cause the greatest disturbance in the detector system's sensor field whereas a human intruder causing an approximately equal disturbance is generally crawling and typically moving much slower than the comparable innocent animal. In the processing means according to the invention the filter is operative to remove signal disturbances caused by a high rate of change of the signal disturbance indicative of a running animal whereas signals caused by a slowly moving crawling intruder are supplied to the second comparator which will actuate the alarm relay if its comparatively low threshold value is exceeded.

Preferably a third channel is included also provided with a second filter and a third comparator having a third predetermined threshold value. In this instance the filter will be set to remove a different range of signal changes intermediate in relation to the first filter. In this way the first channel will detect large fast moving intruders, the second channel will detect small slowly moving intruders and the third channel will detect average size and speed intruders, for example, an intruder crawling on hands and knees.

Preferably the filter on the second channel is set to block or remove signal disturbances having a frequency of the order of one hertz or higher. This frequency is typical of the rate of change of signal amplitude generated by an animal disturbing the sensor field.

DESCRIPTION OF THE DRAWING

The invention will be described further by way of example with reference to the accompanying drawings in which.

DESCRIPTION OF THE INVENTION

Figure 1:
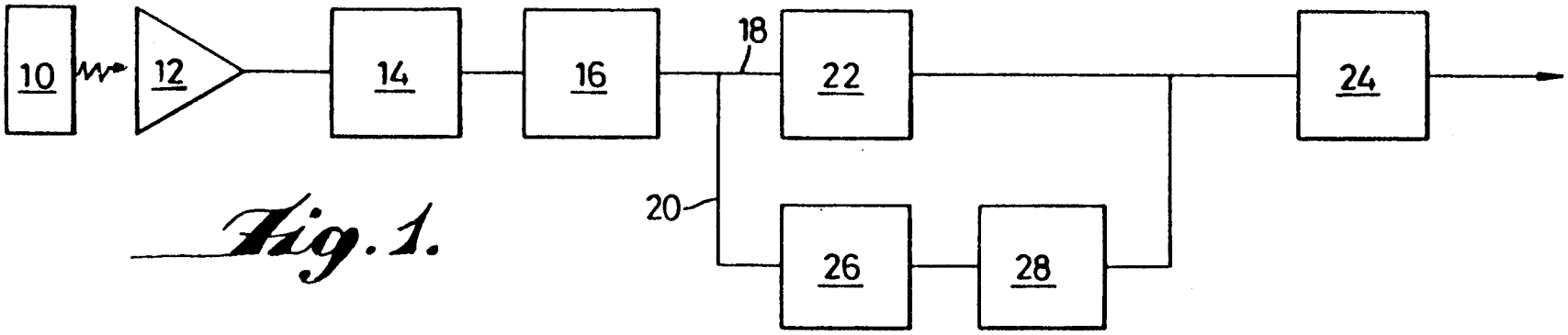
FIG. 1 is a block diagram of a first preferred embodiment of the signal processing means according to the invention

Referring firstly to FIG. 1 an intruder detector system using a microwave fence includes a plurality of high frequency transmitter/receiver combinations such as those described in UK Patent No. 1409658. A transmitter 10 is set up facing its associated receiver 12 which is typically around 100 meters from the transmitter although precise distance may be more or less than this depending on operational characteristics and requirements. The transmitter transmits a high frequency signal which is received by the receiver which is typically in the form of an antenna. The signal received by the antenna 12 is supplied to a microwave detector 14 usually in the form of a detector diode, the output of which consists of the modulated signal characteristic of the sensor output. Such an arrangement is commonly known as a microwave fence.

The output from the microwave detector 14 is fed to a processor 16 which converts the AC signal to a DC voltage which has a value proportional to any variation in the received signal strength. Thus the DC voltage output from the processor is related to any disturbance caused in the sensor field by the presence of an intruder. As the disturbance to the received signal strength fluctuates over a period of time the DC voltage output from the processor will also vary in value as well as in polarity. This output from the processor is split into two channels, first channel 18 and second channel 20. The first channel 18 includes a first threshold detector and comparator 22 which compares the DC signal output from the processor with a predetermined threshold value. When the output from the processor exceeds the predetermined value the detector and comparator 22 actuates an alarm relay 24 which in turn will activate an alarm signalling device, for example, a bell or visual signal such that the system's operator will be aware of an intrusion in the sensor field. The second channel 20 includes a filter 26 and a second threshold detector/comparator 28. The filter 26 is preset to block high frequency changes of the order of one hertz or higher and thus the signal output from this filter includes only variations caused by relatively slow changes in the measured signal strength. Such a signal will be indicative of a slowly moving intrusion into the microwave fence usually caused by a crawling human intruder. Animal generated disturbances of a similar strength would be typically at a higher frequency and would therefore be attenuated by the filter and thus not be received by the threshold detector/comparator 28. The signal output from the filter on being supplied to the threshold detector/comparator is compared with a second relatively small predetermined threshold value and when the measured signal exceeds this predetermined value an output causes actuation of the alarm relay 24 and thence as previously activation of an appropriate alarm signalling device.

It will be understood that the first channel is operative to detect a disturbance in a signal indicative of a large fast moving target, for example, a running, human intruder. Signals not corresponding to this are recognized as being lower than the predetermined threshold value and thus do not cause actuation of the alarm relay 24. The filter 26 present in the second channel 20 removes signal disturbances having a high rate of change (frequency) which signals are usually caused by a fast moving intruder. As a human intruder when presenting a small target will be crawling the signal disturbance will have a relatively slow rate of change due to the relatively slow movement possible to a human in this position. The signals indicative of such an intrusion are passed through the filter 26 to the second threshold detector/comparator 28. The second threshold value stored in the detector/comparator 28 is set at a level to reject signals caused by very small animals, for example, birds etc. whilst still reacting to alarm signals generated by crawling intruders. In this way the alarm relay will be actuated by either a disturbance caused by a running man or by a crawling man passing through the sensor field.

Figure 2:
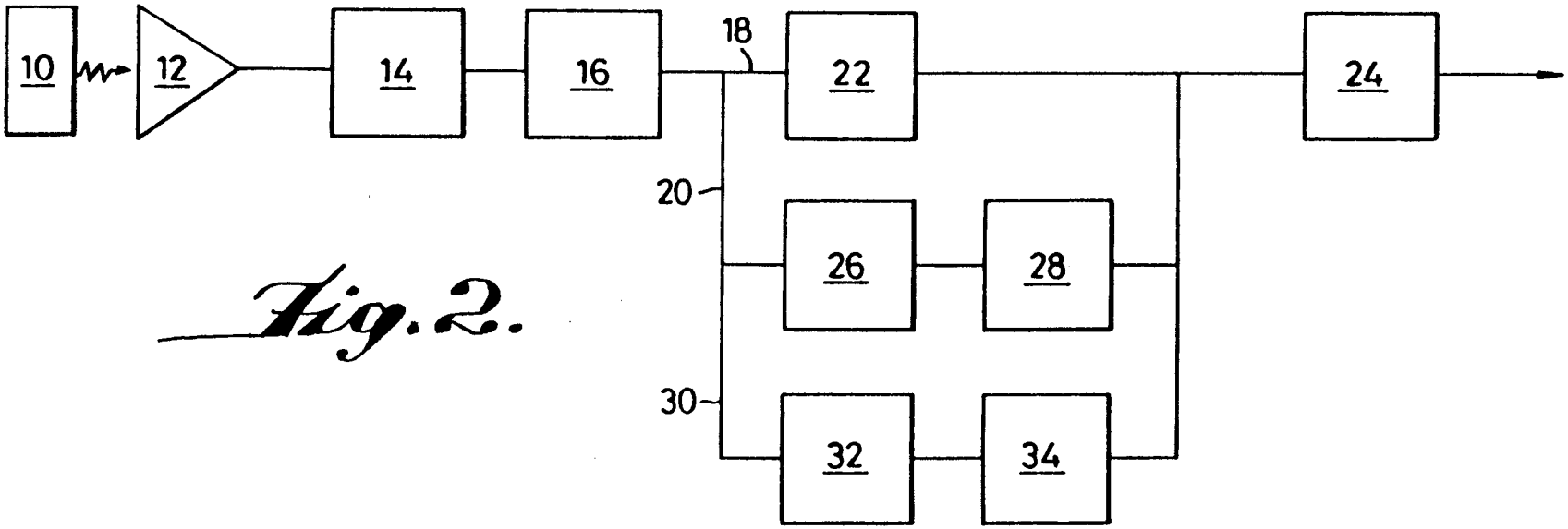
FIG. 2 is a block diagram of a second embodiment of the original invention.
Figure 3:
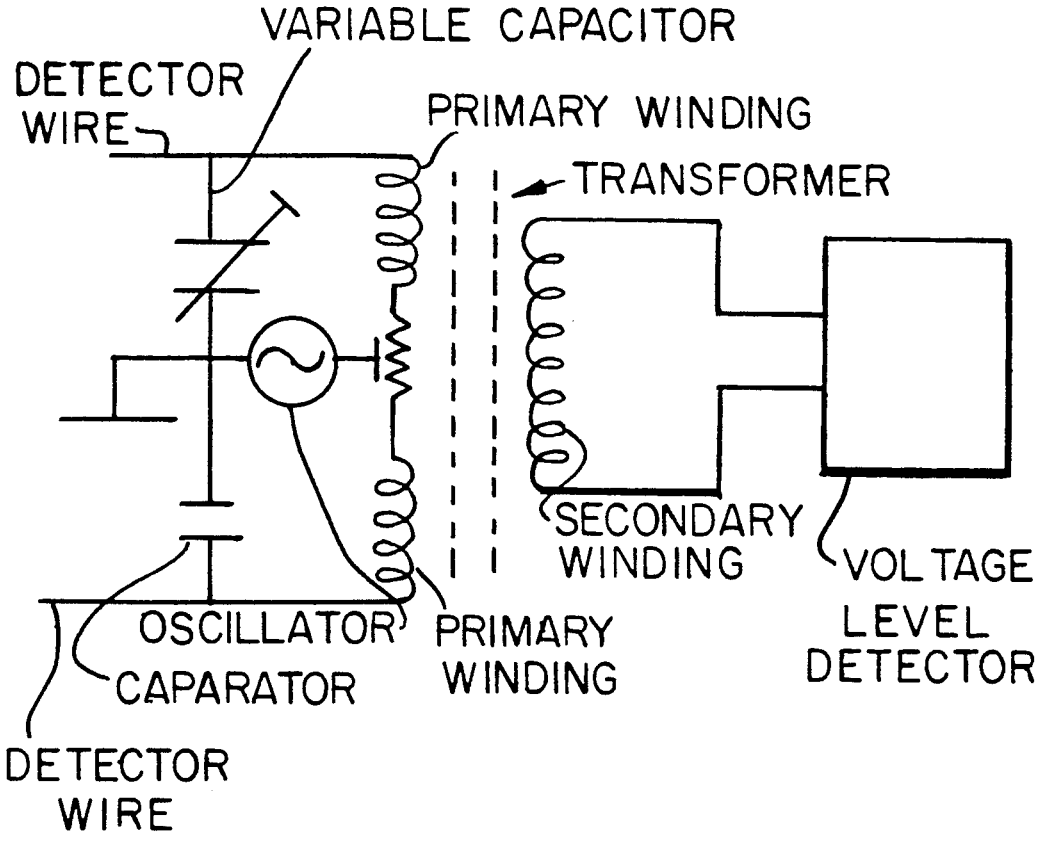
FIG. 3 is an illustrator of a parallel wire capacitance change detector.

FIG. 2 illustrates a second embodiment of the invention. All elements previously referred to such as the transmitter 10, the receiver 12, the microwave detector 14, processor 16, first and second channels 18, 20 etc. are all present in this second embodiment and are therefore referred to by the same reference numerals. In the second embodiment a third channel 30 is present, generally similar in ciruitry to the second channel 20. The third channel 30 therefore incorporates a second filter 32, typically of a band pass type and a third threshold detector/comparator 34 having a further predetermined threshold value. As previously noted where the output from the second filter 32 exceeds the predetermined third threshold value in the detector/comparator 34 a signal is output causing actuation of the alarm relay 24. The purpose of this third channel 30 is to detect disturbances caused by an average sized intruder at a relatively medium speed. Such a disturbance would be typical of a human intruder crawling on hands and knees who would present a cross-section and a disturbance typical of a large animal, for example, a dog. The disturbance caused by such a signal may be rejected by the first detector/comparator 22 if the value has been pre-set in order to reject signals caused by dogs.

As previously discussed a human crawling on hands and knees cannot attain the same speed and hence frequency of signal disturbance as would be characteristic of a dog and therefore the second filter 32 present in this third channel will eliminate disturbances caused by genuine dog sized animal target whilst still permitting a relatively slowly moving signal caused by a human intruder to be passed to the detector/comparator 34 to cause actuation of the alarm relay 24.

If required further channels could be included in the invention in order to distinguish more particular types of signal variation.

The invention has been described as applied to a "microwave fence" however, its application is not limited to this type of intruder detector and alarm processing means according to the invention may be attached to any intruder detection apparatus in which the signal from the sensor is proportional to the signal disturbance and varies according to the rate of movement of the disturbance through the sensor field.

Thus it will be understood that the processing means may be applied to the commonly known parallel wire electric field sensor in which two sensor wires are supported parallel to each other and horizontal to the ground on insulated posts. Such an arrangement is described in more detail in British Patent No. 2040093. The wires are connected to the primary windings of a transformer and are energised by an oscillator at a frequency of typically tens of kilohertz. This configuration would then be balanced by means of a potentiometer and a variable capacitor. In this configuration when a circuit is balanced there will be no voltage induced in the secondary winding of the transformer, however when a person, for example, an intruder encroaches on either wire, a degree of imbalance will be induced into the system according to the proximity of the intruder to the sensor wire. Thus by measuring the voltage in the secondary coil of the transformer a signal may be obtained proportional to the disturbance in the sensor arrangement. Such a signal may then be supplied to the processing means as previously illustrated in place of the DC voltage output from the processor 16 in FIGS. 1 and 2 and as previously described. Other sensor systems providing a similar signal for processing may also be used with the present invention.

I claim:

1. Alarm signal processing means connected to an intruder detector system which outputs a signal proportional to a disturbance from a predetermined state of an existing signal, the processing means comprising at least first and second channels connected in parallel to the detector system, said first channel including a first signal comparator operative in a first predetermined signal frequency range and having a first predetermined signal threshold value and said second channel including a filter operative to block signal disturbances of and above a predetermined frequency corresponding to a high rate of change in said existing signal and a second signal comparator operative in a second predetermined signal frequency range and having a second predetermined signal threshold value, the first and second signal comparators being connected to an alarm actuator such that on detection by either comparator of a signal disturbance exceeding either of the first or second comparator's respective threshold values an alarm control signal is produced to cause actuation of an alarm.

2. Alarm signal processing means as claimed in claim 1 further comprising a third channel provided with a second filter and a third comparator having a third predetermined threshold value.

3. Alarm signal processing means as claimed in claim 1 wherein the first threshold value is greater than the second threshold value.

4. Alarm signal processing means as claimed in claim 3 wherein the filter blocks signals having a frequency larger than 1 Hz.

5. Alarm signal processing means as claimed in claim 1 wherein the filter blocks signals having a frequency larger than 1 Hz.

6. Alarm signal processing means as claimed in claim 1 wherein the intruder detector system comprises a high frequency transmitter/receiver combination.

7. Alarm signal processing means as claimed in claim 1 wherein the intruder detector system comprises a parallel wire capacitance charge detector arrangement.

8. Alarm signal processing means as claimed in claim 1 wherein said alarm actuator comprises an alarm relay connected to the first and second comparators to cause activation of the alarm actuator.

9. Alarm signal processing means, comprising:

intruder detection system including a transmitter for transmitting a high frequency signal, a receiver spaced from said transmitter and for receiving said high frequency signal;

detector means connected to said receiver of said intruder detection system and for sensing deviations in said high frequency signal;

processing means connected to said detector means and for converting said sensed changes to a voltage with a value proportional to said sensed changes;

at least two channels connected in parallel to said processing means, one of said at least two channels including a first threshold comparator for comparing said proportional voltage to a first predetermined threshold value and outputting a first actuating signal if said proportional voltage exceeds said first predetermined threshold voltage, a second of said at least two channels including filter means for passing only signal disturbances of below a predetermined frequency corresponding to a low rate of change of said sensed deviations, a second threshold comparator connected to said filter means and for comparing said proportional voltage to a second predetermined threshold voltage and outputting a second actuating signal if said proportional voltage exceeds said second predetermined threshold voltage; and alarm means, connected to said first and second threshold comparators, for receiving at least one of said actuating signals and for activating an alarm in response to a predetermined status of said received signals.

* * * * *